US005210803A

United States Patent [19]

Martin et al.

[11] Patent Number: 5,210,803

[45] Date of Patent: May 11, 1993

[54] HEARING AID HAVING A DATA STORAGE

[75] Inventors: Raimund Martin, Erlangen; Jürgen Wagner, Kueps, both of Fed. Rep. of Germany

[73] Assignee: Siemens Aktiengesellschaft, Munich, Fed. Rep. of Germany

[21] Appl. No.: 769,731

[22] Filed: Oct. 2, 1991

[30] Foreign Application Priority Data

Oct. 12, 1990 [EP] European Pat. Off. ..... 90119638.6

[51] Int. Cl.[5] ..... H04R 25/00

[52] U.S. Cl. ..... 381/68; 381/68.2; 381/68.4

[58] Field of Search ..... 381/68, 68.2, 68.4, 381/69, 68.7, 68.6, 60; 73/585

[56] References Cited

U.S. PATENT DOCUMENTS

| | | | |
|---|---|---|---|
| 4,680,798 | 7/1987 | Neumann | 381/68.4 |
| 4,821,247 | 4/1989 | Grooms | 368/63 |
| 4,845,755 | 7/1989 | Busch et al. | 381/68 |
| 4,918,736 | 4/1990 | Bordewijk | 381/68 |
| 4,947,432 | 8/1990 | Tøpholm | 381/68.4 |
| 4,992,966 | 2/1991 | Widin et al. | 364/571.04 |
| 5,007,090 | 4/1991 | Bransky et al. | 381/68.2 |
| 5,012,520 | 4/1991 | Steeger | 381/68.6 |

FOREIGN PATENT DOCUMENTS

| | | |
|---|---|---|
| 0175909 | 8/1985 | European Pat. Off. . |
| 0341995 | 5/1989 | European Pat. Off. . |
| 671131 | 7/1989 | Switzerland . |

*Primary Examiner*—Jin F. Ng
*Assistant Examiner*—Huyen D. Le
*Attorney, Agent, or Firm*—Hill, Steadman & Simpson

[57] ABSTRACT

A hearing aid is provided comprising a microphone, an amplifier, an earphone, and at least one data storage. A large number of detailed hearing aid features are identifiable in an easy way. The data storage forms a component part of an identification means and stores at least one hearing aid feature which can be wirelessly output via an output means of the identification means allocated to the hearing aid for the identification of the hearing aid.

17 Claims, 3 Drawing Sheets

HEARING AID HAVING A DATA STORAGE

BACKGROUND OF THE INVENTION

The present invention is directed to a hearing aid comprising a microphone, an amplifier, an earphone, and a data storage.

Known hearing aids of the type initially cited have their transmission properties individually matched to the respective residual hearing of a user of the hearing aid. A great number of types of hearing aids are required for this purpose. Even hearing aids having a structurally identical housing can differ considerably from one another in terms of their electrical type (electrical data) due to the different parts integrated therein such as, for example, microphone, earphone and/or electrical amplifier circuits, or due to the different performance data of these integrated components of the hearing aid. A presentation of more detailed distinguishing features (transmission properties) of the respective hearing aid type at the housing of the hearing aid for precise identification of the hearing aid is not possible, if only because of inadequate space at the respective hearing aid, particularly at an in-the-ear hearing aid.

CH-A-671 131, incorporated herein, discloses a hearing aid whose data storage also contains memory locations for only one type of information that can be output in wire-bound fashion to a programming device. What this is intended to achieve is that the audio channels of hearing aids differing in type can be rapidly set in succession with a single programming device. The wire-bound output, however, requires at least one space-consuming plug contact at the hearing aid.

EP-A-0 341 995, incorporated herein, discloses a hearing aid having a data storage as a component part of a calibration means. The calibration means stores data about individual characteristics of the individual hearing aid. A programming system is programmed with these data. An external programming means and an input and output unit in the hearing aid are provided for this purpose.

Knowledge of detailed transmission properties (hearing aid feature/hearing aid data), however, is required for a correct matching of the hearing aid to the residual hearing of the hearing-impaired user. Persons, for example audiologists, who adapt hearing aids to hearing impairments must therefore laboriously seek out the relevant hearing aid features in a time consuming way in separate data lists with reference to the type and manufacturer identification arranged at the housing of the hearing aid. Such lists must always be kept up to date, this involving additional time expenditure. On occasion, data lists in the possession of the audiologist are already superseded. Consequently, time-consuming measurements must be implemented at the hearing aid in order to exactly identify hearing aid properties.

SUMMARY OF THE INVENTION

It is an object of the invention to facilitate the identification of more detailed hearing aid features of hearing aids of the type initially cited. Furthermore, the number of hearing aid features identifiable at the hearing aid should be increased, without a significantly greater space requirement. This object is achieved by providing a hearing aid having a microphone, an amplifier, an earphone, and at least one data storage. The data storage forms a component part of an identification means. At least one hearing aid feature is stored in the data storage. This at least one feature is capable of being output in wireless fashion via an output means of the identification means allocated to the hearing aid for the purpose of identifying the hearing aid.

In the invention, at least one data storage is employed as a component part of an identification means for a hearing aid and for storing at least one feature of the hearing aid. The data storage can be formed by an electrically conductive connection to at least one component part of the identification means, and as a component part of the identification means. This identification means comprises at least one output means in the hearing aid via which hearing aid features stored in the data storage can be output in wireless fashion for the exact identification of the hearing aid. Such features that unambiguously identify the hearing aid and/or the properties thereof can be input into the data storage in great numbers in the form of, for example, electronic data. This great number of stored features can be called in from the data storage of the hearing aid without data lists which must be kept up to date having to be consulted for this purpose. It is also not necessary to open the housing of the hearing aid and/or to dismantle the hearing aid. It is particularly programmable hearing aids that usually already comprise a data storage that, given an adequate memory capacity, can also be advantageously inventively employed or designed. The space required for the storing and output of features identifying the respective hearing aid requires considerably less space than traditional data particulars on the hearing aid housing in, for example, written form. Considerably more features/parameters of the hearing aid are nonetheless identifiable, these always being up to date, i.e. corresponding to the respective hearing aid.

The respective output means of the hearing aid for the wireless output of the stored data which unambiguously identify the respective hearing aid can be designed in a great variety of ways. In a development of the invention, thus a display means for visual presentation (optical output) of the hearing aid data can be realized as output means at a hearing aid which offers adequate space for this, particularly at a behind-the-ear hearing aid. This display means can be designed as a small display, for example a LCD display (liquid crystal display). The presentation can occur in chronologically successive characters. The characters can also be output as successive words and/or numbers.

Further, the output means can also be designed as an interface to an external data viewing means having a display means. In such an embodiment of the invention, the data for identifying features of a hearing aid can also be output in wireless fashion in some other way, particularly inductively or acoustically via the output means. According to an alternative of the invention, the output can occur inductively via the telephone coil of the hearing aid which is usually present. According to another alternative, the stored data can be output as audio signals via the earphone of the hearing aid. The earphone that is usually present in the hearing aid, or the telephone coil which is usually present therein, is co-employed in this alternative of the invention as an interface (output means) for a wireless data output. The display means of the external data viewing means forms a component part of the identification means which is wirelessly connected to the hearing aid. As a result of the wireless output of hearing aid features via the earphone or the telephone coil, a separate output means (for example a plug) for the identification of the hearing aid with reference to the data stored for that purpose can be advantageously eliminated, this further reducing the required space. For wireless forwarding of the output data to an external component part of the identification means, the hearing aid can be coupled to an inductive or to an acoustic coupler. Given adequate capacity of the data storage of the identification means, it is also possible to output the audio signal for the data output as a voice signal that may be understood by a human being.

The data output via the output means for features of the hearing aid can be triggered by a control signal. This control signal can be initiated by actuating a switch means at the hearing aid. The switch means can be realized at the hearing aid by two simultaneously contactable conductor ends. These conductor ends can be touched in bridging fashion with the electrically conductive end of a screwdriver for contacting. The bridgeable conductor ends can be arranged in covered fashion in the battery compartment of the hearing aid. In combination with a wireless remote control, the control signal can also be triggered via infrared, radio-frequency or ultrasound. Since the output of hearing aid features also occurs in wireless fashion, feature/parameters of the hearing aid are easily identifiable completely free of wired connections and/or space-consuming plug connections at the hearing aid.

DESCRIPTION OF THE PREFERRED EMBODIMENTS

Figure 1:
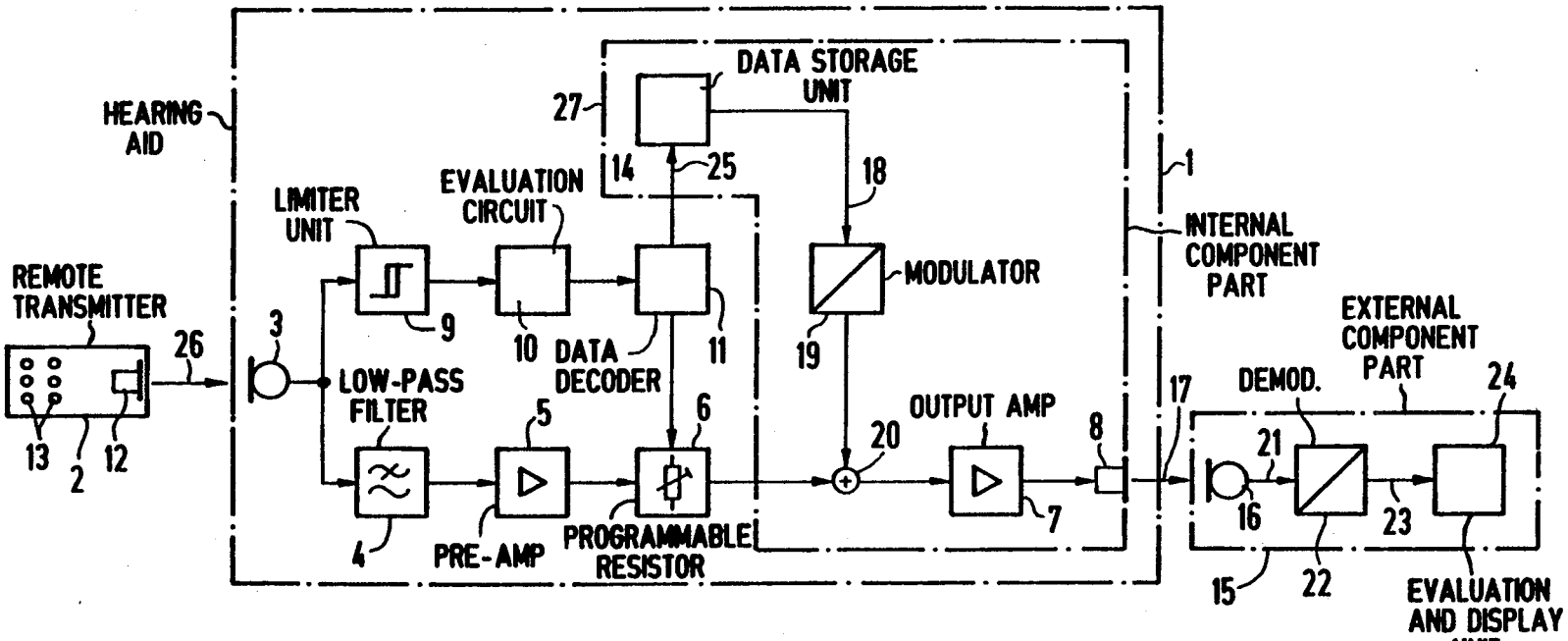
FIG. 1 shows a schematic block circuit diagram of a hearing aid of the invention comprising internal and external component parts of an identification means.

FIG. 1 shows a programmable, remotely controllable hearing aid 1 having a separate remote control transmitter 2. The hearing aid 1 comprises a microphone 3, a low-pass filter 4 for audio signals, a pre-amplifier 5, a programmable electronic resistor 6, an output amplifier 7, and an earphone 8. The hearing aid further comprises a remote control part composed of a limiter unit 9 that, for example, can be designed as a Schmitt trigger having a preceding high-pass filter (not shown), and is also composed of an evaluation circuit 10 and of a data decoder 11.

Via an output sound transducer 12, the remote control transmitter 2 outputs audio signals, for example ultrasound remote control signals, which are triggered and coded with the assistance of a key control 13, these audio signals being received by the microphone 3 of the hearing aid, being decoded in the data decoder 11, and being allocated to a remotely controllable or, respectively, programmable component part. To this extent, the hearing aid of FIG. 1 fundamentally corresponds to a hearing aid disclosed by and described in detail in EB-A-0 175 909, incorporated herein.

The hearing aid 1 of the invention comprises a data storage unit 14 that forms a component part of an identification means. Features of the hearing aid are input in storable form into the data storage unit 14 as digital data. The input can already be undertaken during the manufacture of the hearing aid or at some other time. The stored data, for example, can contain the name of the manufacturer, the type designation, version of the apparatus, series of the apparatus, and/or technical data such as amplification, frequency response, limitation threshold and/or output level, etc., i.e. data that could hitherto particularly be taken from separate data lists. The stored data can be output via an output means allocated to the hearing aid 1. For that purpose, the earphone 8 of the hearing aid 1 which is already present is advantageously also employed in this specific embodiment. Both the separate output means as well as the space required for that purpose are thus eliminated. The earphone 8 and the storage 14 are consequently employed as an internal component part 27 of the identification means.

According to the exemplary embodiment of FIG. 1, an external component part also belongs to this identification means. Via a microphone 16 acting as an acoustic coupler, the external component part 15 of the identification means receives in wireless fashion the features of the hearing aid 1 output by the earphone 8 as coded sound signals—symbolized by the arrow 17—these features being stored as digital data in the storage unit 14.

In the hearing aid 1, the digitally stored data of the storage unit 14 are supplied to a modulator 19 as a serial data stream via a line 18. The modulator 19 that can be designed as a component part of an integrated circuit, comprises, for example, a low-frequency generator (not shown) which is modulated with the serial data stream from the storage unit 14 in an intrinsically known way. Included among the suitable modulation methods are pulse duration modulation and frequency shift keying (FSK modulation). The modulated low-frequency signal (audio frequency signal) is supplied to a summing circuit 20 present in the actual hearing aid amplifier parts 5 through 7, is amplified in the output amplifier 7, and is ultimately output via the earphone 8 as a coded sound signal (arrow 17).

The coded sound signal is then picked up by the microphone 16 and is supplied to a demodulator 22 via a line 21 as a modulated audio frequency signal. After the demodulation, a data stream corresponding to the data stream of the line 18 in the hearing aid 1 arises. This data stream is supplied via a line 23 to an evaluation and display means 24 for display of the stored features of the hearing aid 1. The external component part 15 of the identification means, particularly the evaluation and display means 24, can be designed, for example, as a component part of a digital programming device for hearing aids.

In an advantageous version of the invention, a coded control signal is generated in the remote control transmitter 2 by actuating an allocated key of the key control 13. The output of hearing aid features from the data storage unit 14 is triggered with this control signal. The control signal is preferably output as an ultra sound signal by the output sound transducer 12, this being symbolized by the arrow 26. The coded control signal is supplied to the remote control parts 9 through 11 in a known way (EPA 0 175 909, incorporated herein) via an input means of the hearing aid 1—via the microphone 3 in this specific exemplary embodiment—and is decoded in the decoder 11. For triggering the output of a feature of the hearing aid 1, the control signal can be supplied to the data storage 14 via the data line 25 that, for example, is designed in multi-pole fashion. The data storage 14 then outputs the stored features as a serial data stream via the line 18. By employing existing hearing aid microphone 3 and the existing remote control parts 9 through 11, a separate input and decoding means for the control signal is advantageously eliminated for triggering the output of features of the hearing aid 1.

The control signal can be coded differently. A first coding can be employed for triggering the output of a single feature. A second coding can be employed for triggering the output of a group of features, and a further coding can be employed for triggering the output of all features. It is thus possible to output only specific features, for example features directed to the transmission properties of the hearing aid, this being advantageous particularly for the fast, and nonetheless detailed, identification.

Figure 2:
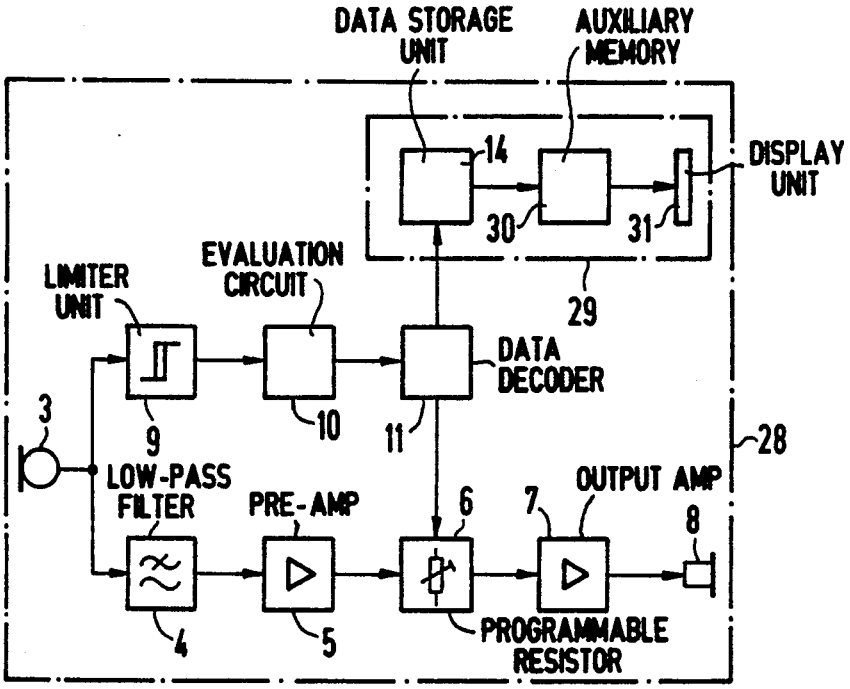
FIG. 2 illustrates a schematic block circuit diagram of a complete internal identification means.

An advantageous version of a hearing aid 28 of the invention shown in FIG. 2 differs from the hearing aid 1 on the basis of an identification means 29 which is completely allocated to the hearing aid 28. The identification means 29 comprises the data storage 14 described in FIG. 1, this being connected to a display means 13 via an auxiliary memory 30. The auxiliary memory 30 serves the purpose of editing the data output for the data storage 14 into a form that can be visually displayed on the display means 31. In particular, the two storages 14 and 30 can be component parts of an integrated circuit..

Figure 3:
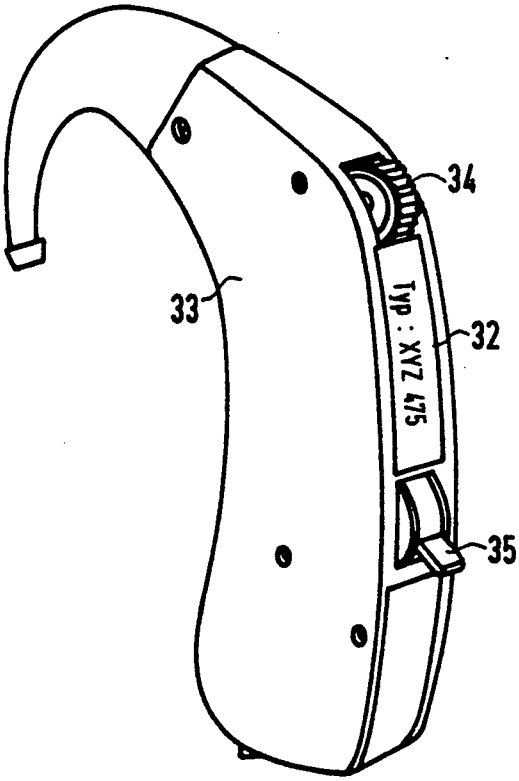
FIG. 3 is a hearing aid of the invention in a behind-the-ear format (a hearing aid to be worn behind the ear) and having a LCD display.

The display means 31 can be designed as an extremely small display, for example, as an LCD display 32, as shown in FIG. 3 at a behind-the-ear hearing aid housing 33. An arbitrarily selected type designation is shown by way of example on the LCD display 32 as a feature which is stored in the data storage 14 of the hearing aid 28 that can be inventively output via the output means—the LCD display 32 in this case. In the exemplary embodiment of FIG. 3, the LCD display 32 is arranged between an adjustment wheel 34 and a switch 35. Other arrangements of the display, for example covered under a flap of the housing 33, are also possible. In particular, the LCD display can be provided instead of previously labelled areas/spaces. Consequently, the great manufacturing expense (stamp, tools, etc.) required for a labelling, particularly with respect to a multi-lingual labelling, is eliminated, this having to be executed differently at the hearing aid dependent on the language area (country) being respectively supplied—due to lack of space. The output with a display can be designed switchable to various languages, without a significant manufacturing expense or space requirement.

Figure 4:
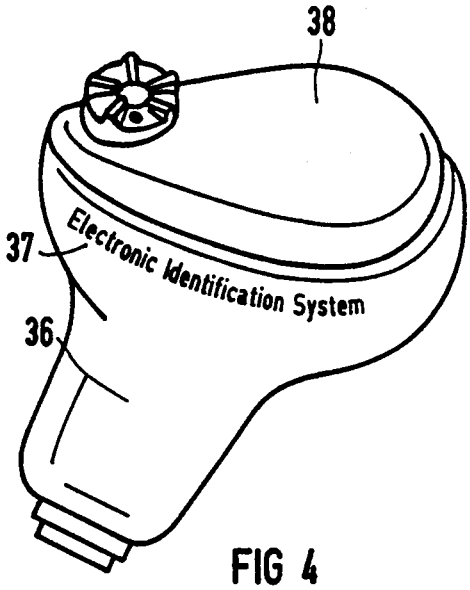
FIG. 4 shows a hearing aid of the invention in an in-the-ear format (a hearing aid to be worn in the ear)

Particularly because of the co-employment of input and output means already present at the hearing aid for the inventive identification of the hearing aid, the inventive hearing aid of FIG. 1 can be designed such that no external difference can be seen vis-a-vis the traditional hearing aids, for example an in-the-ear hearing aid housing 36 of FIG. 4. In order to prevent a person from proceeding in the manner initially set forth for the exact identification of the hearing aid, it is provided in a development of the invention that, in particular, the hearing aid of FIG. 1 has a traditional type of identification indicating the inventive identification of the hearing aid, as shown by a label 37 in FIG. 4. This can be achieved, for example, by the label "Electronic Identification System." However, it is also possible to equip the in-the-ear hearing aid housing 36 with an LCD display (not shown) in the region of the face plate 38.

Figure 5:
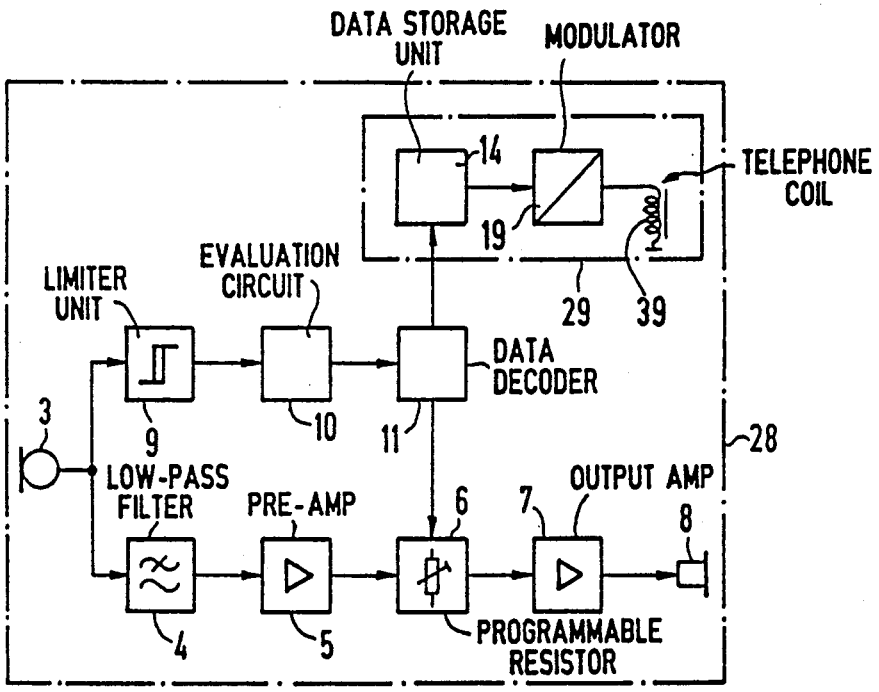
FIG. 5 shows an alternate embodiment of a hearing aid of the invention having a telephone coil.

FIG. 5 shows an alternate embodiment of the invention similar to FIG. 2, but wherein in lieu of outputting with the display unit 31 and auxiliary memory 30, a modulator 19 and a telephone coil 39 are provided. With this embodiment, output is achieved in wireless fashion inductively via the telephone coil. Thus, either the telephone coil or the earphone of the hearing aid may be co-employed as an interface (output means) for wireless data output.

Although various minor changes and modifications might be proposed by those skilled in the art, it will be understood that we wish to include within the claims of the patent warranted hereon all such changes and modifications as reasonably come within our contribution to the art.

We claim as our invention:

1. A hearing aid, comprising:

a microphone, an amplifier connected to the microphone, and an earphone connected to an output of the amplifier;

first means for identifying the hearing aid, said identification means having a data storage containing at least one hearing aid feature which provides information for a person to identify the hearing aid and thus allow that person to match the hearing aid to a particular hearing impairment of a user who will be wearing the hearing aid;

and second means for wirelessly outputting to said person the at least one hearing aid feature.

2. A hearing aid according to claim 1 wherein said second means includes said earphone connected to serve both as an output of the hearing aid for amplified sound and also for outputting said at least one hearing aid feature.

3. A hearing aid according to claim 1 wherein said first means outputs from said hearing aid said at least one feature via said earphone.

4. A hearing aid according to claim 1 wherein a telephone coil of the hearing aid is employed as part of said second means.

5. A hearing aid according to claim 1 wherein said second means comprises a display means arranged in the hearing aid for outputting by visual presentation said at least one feature of the hearing aid.

6. A hearing aid according to claim 1 wherein said second means includes means for transmitting said at least one feature of the hearing aid as a coded signal to a separate evaluation and display unit which is separate from a main body of the hearing aid and which has a display means for visual presentation of said at least one feature of the hearing aid.

7. A hearing aid according to claim 1 wherein a triggering means is connected to said first means for triggering output of said at least one feature of the hearing aid when a control signal is received.

8. A hearing aid according to claim 7 wherein said triggering means comprises means for generating an externally generated control signal which is input via said microphone of the hearing aid.

9. A hearing aid according to claim 8 wherein said triggering means includes remote control means for transmitting a signal to said microphone of said hearing aid for triggering an output of said at least one feature of the hearing aid.

10. A hearing aid according to claim 8 wherein said control signal for outputting a feature of the hearing aid comprises a sound signal and said microphone of the hearing aid is employed as input means for the control signal.

11. A hearing aid according to claim 1 wherein said data storage contains a plurality of hearing aid features including transmission properties of the hearing aid.

12. A hearing aid according to claim 1 wherein the hearing aid has printed thereon an indication that it contains an electronic identification system.

13. A hearing aid, comprising:

a microphone connecting through an amplifier to an earphone;

identification means for identifying at least one operating feature of the hearing aid which provides information to allow a person to identify the hearing aid and thus allowing that person to match the hearing aid to a particular hearing impairment of a user who will be wearing the hearing aid, said identification means including a data storage;

output means for wireless output of data from the hearing aid to said person; and said identification means including means for providing said at least one feature to said output means as a result of a command received through said microphone and externally transmitted in wireless fashion to said hearing aid.

14. A hearing aid according to claim 13 wherein said output means includes a modulator connecting to said earphone, and wherein an external evaluation display means is provided to receive signals from said earphone and for displaying the at least one feature.

15. A hearing aid according to claim 13 wherein a remote transmitting means is provided for sending signals to said microphone for storing data in said data storage.

16. A hearing aid according to claim 13 wherein a transmitter means is provided for providing a trigger signal to actuate release of said at least one hearing aid feature from said data storage in said identification means.

17. A hearing aid, comprising:

a microphone connecting through an amplifier to an earphone;

identification means coupled to said microphone for identifying at least one operating feature of the hearing aid which provides information to allow a person to identify the hearing aid and thus allowing that person to match the hearing aid to a particular hearing impairment of a user who will be wearing the hearing aid, said identification means including a data storage; and output means connected to said identification means for outputting, as a result of a command received through said microphone, said at least one hearing aid feature through a display means located on the hearing aid.

* * * * *